United States Patent [19]
Kuze et al.
[11] 4,198,588
[45] Apr. 15, 1980

[54] ANODE BUTTON FOR A CATHODE RAY TUBE

[75] Inventors: Takashi Kuze, Yokohama; Hajime Makio, Shiga; Yukio Baba, Hikone, all of Japan

[73] Assignees: Tokyo Shibaura Denki Kabushiki Kaisha; Nippon Electric Glass Co., Ltd., both of Kawasaki, Japan

[21] Appl. No.: 928,616

[22] Filed: Jul. 27, 1978

[30] Foreign Application Priority Data

Aug. 1, 1977 [JP] Japan ..... 52-91422
Aug. 1, 1977 [JP] Japan ..... 52-91423

[51] Int. Cl.[2] ..... H01J 29/92; H01J 5/52
[52] U.S. Cl. ..... 313/479; 313/318
[58] Field of Search ..... 313/479, 477 HC, 477, 313/482, 318

[56] References Cited

U.S. PATENT DOCUMENTS

| | | | |
|---|---|---|---|
| 1,916,204 | 7/1933 | Colby | 417/48 |
| 3,582,978 | 6/1971 | Peterson et al. | 313/482 |
| 3,600,620 | 8/1971 | Slick et al. | 313/479 |
| 3,666,343 | 5/1972 | McNeill | 313/477 X |
| 4,106,840 | 8/1978 | Tyson | 313/318 X |

FOREIGN PATENT DOCUMENTS

| | | |
|---|---|---|
| 52-21763 | 2/1977 | Japan . |
| 52-91753 | 5/1977 | Japan . |
| 565274 | 11/1944 | United Kingdom . |
| 602236 | 5/1948 | United Kingdom . |
| 792489 | 3/1958 | United Kingdom . |
| 1135271 | 12/1968 | United Kingdom . |
| 1204216 | 9/1970 | United Kingdom . |
| 1246740 | 9/1971 | United Kingdom . |
| 1309493 | 3/1973 | United Kingdom . |

*Primary Examiner*—Palmer C. Demeo
*Attorney, Agent, or Firm*—Cushman, Darby & Cushman

[57] ABSTRACT

An anode button for a cathode ray tube comprises an outer cup having a peripheral wall made so thin as to be well sealed to a glass bulb and an inner cup disposed in the outer cup for minimizing X-ray leak. A space is provided between the outer and inner cups so that the seal between the outer cup and the glass bulb is not damaged.

3 Claims, 9 Drawing Figures

ANODE BUTTON FOR A CATHODE RAY TUBE

This invention relates to an anode button to be used as an anode terminal of a cathode ray tube (CRT).

Generally, anode buttons are used as anode terminals of TV cathode ray tubes or observation cathode ray tubes with post-acceleration. To maintain a high vacuum in a cathode ray tube an anode button should be sealed to the wall of the cathode ray tube in a steadfast and stable condition. Accordingly, the improvement thus far made to an anode button is chiefly concerned with the seal between the anode button and the wall of the cathode ray tube. In recent years anode buttons have been so improved as to be sufficiently sealed to the wall of a cathode ray tube.

It is strongly desired that X-ray leak out of a cathode ray tube be fully reduced. To this end, various improvements have been made to glass bulbs which constitute cathode ray tubes. Today X-ray leak through glass bulbs can be reduced to a practically negligible amount. In contrast to glass bulbs, anode buttons have not been improved in order to reduce X-ray leak through them to a practically negligible degree. Perhaps this is chiefly because an anode button occupies but an extremely small area in the entire cathode ray tube. And this partly because X-ray leak from the anode button has called little attention since the anode button is covered with an outer terminal. As the X-ray leak through the glass bulb is successfully reduced more and more, the X-ray leak through the anode button can hardly be neglected today.

Recently various methods have been invented to minimize X-ray leak through an anode button. One known method is, as disclosed in Japanese Utility Model Application laid open under Disclosure No. 52-91753, to plate an anode button with a thin film which can shield X-ray. Another known method is, as disclosed in Japanese Utility Model Application laid open under Disclosure No. 52,21763, to provide inside an anode button with a rubber-like material which can shield X-ray. In the first method the thin film is formed by a chemical process and can not be made sufficiently thick. The film therefore fails to shield X-ray to a satisfactory degree. In the latter method the rubber-like material may shield X-ray more effectively than the film used in the first method. Both known methods, however, are disadvantageous in the following respect.

Namely, the thin film or rubber-like material can not be plated on, or disposed within, the anode button until after the anode button is sealed to a glass bulb. If the anode button provided with a thin film or rubber-like material is sealed to a glass bulb, the film or material will be damaged by the heat during the sealing process and will fail to shield X-ray to a sufficient degree. Thus, in the conventional methods of reducing X-ray leak through an anode button, the anode button must undergo a treatment for reduction of X-ray leak after it has been sealed to a glass bulb.

An object of this invention is to provide an anode button for a cathode ray tube, which can be well sealed to a glass bulb constituting a cathode ray tube and which is so constructed as to reduce X-ray leak.

To achieve this object, in an anode button according to this invention, that portion of the anode button which is to be exposed to X-ray is made thick to shield X-ray, and that portion of the anode button which is to be sealed to a glass bulb is made thin to be well sealed to the glass bulb.

With reference to FIGS. 1 to 9 the preferred embodiments of this invention will be described. To simplify the description hereinafter, like reference numerals designate like or corresponding parts throughout the drawings.

Figure 1:
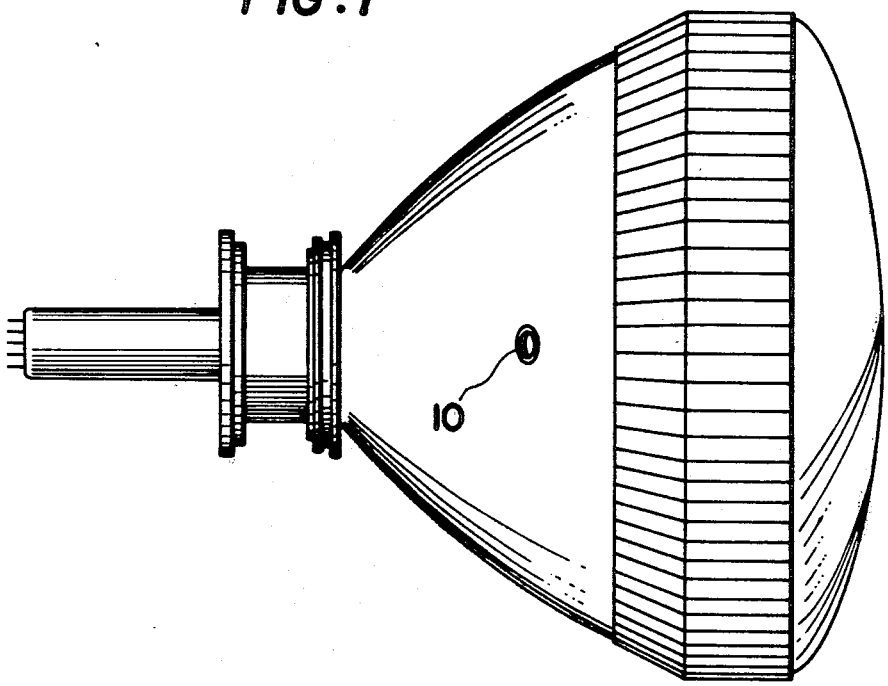
FIG. 1 shows a cathode ray tube provided with an anode button.
Figure 2:
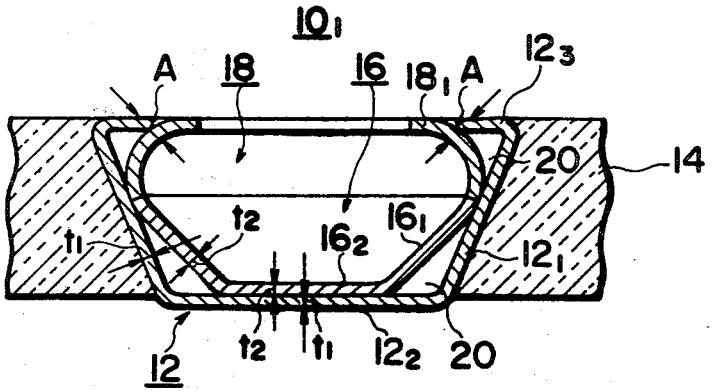
FIG. 2 is a cross sectional view of an anode button according to this invention, sealed to the glass bulb of a cathode ray tube.

FIG. 1 shows an anode button 10 attached to the funnel portion of a glass bulb which constitutes a cathode ray tube. As shown in FIG. 2, the anode button $\mathbf{10_1}$ comprises an outer cup 12 and a first inner cup 16. The outer cup 12 is sealed to a glass bulb 14 at its peripheral wall $\mathbf{12_1}$. The peripheral wall $\mathbf{12_1}$ is made relative thin, for example 0.2 to 0.8 mm thick, so that the outer cup 12 is well sealed to the glass bulb 14. The first inner cup 16 is disposed in the outer cup 12 so as to reduce X-ray leak through the anode button $\mathbf{10_1}$. The first inner cup 16 has its bottom $\mathbf{16_2}$ in contact with a bottom $\mathbf{12_2}$ of the outer cup 12 and the upper edge of its peripheral wall $\mathbf{16_1}$ in contact with the peripheral wall $\mathbf{12_1}$ of the outer cup 12. The upper edge of the wall $\mathbf{16_1}$ is line (or point) contacted with the wall $\mathbf{12_1}$.

The anode button $\mathbf{10_1}$ further comprises a second inner cup 18 which is mounted on the upper edge of the first inner cup 16. The second inner cup 18 has an opening and is constituted by a curved peripheral wall $\mathbf{18_1}$. The peripheral wall $\mathbf{18_1}$ is put in contact at a portion A with a flange $\mathbf{12_3}$ of the outer cup 12. Owing to the spring-back of the flange $\mathbf{12_3}$ and the peripheral wall $\mathbf{18_1}$, the portion A of the second inner cup 18 is exerted with a resilient force. This resilient force acts to secure the first inner cup 16 steadfastly within the outer cup 12.

Accordingly two annular spaces 20 are provided, one between the outer cup 12 and the first inner cup 16 and the other between the outer cup 12 and the second inner cup 18. Owing to these annular spaces 20 the heat capacity of the peripheral wall $\mathbf{12_1}$ of the outer cup 12 is scarcely increased by the inner cup 16 or 18. That is, the heat capacity of the peripheral wall $\mathbf{12_1}$ is small. The anode button $\mathbf{10_1}$ can therefore be sealed to the glass bulb 14 in a desired state.

If the anode button $\mathbf{10_1}$ is constructed as described above, X-rays, if leaking through the anode button $\mathbf{10_1}$, must pass through the outer cup 12, the first inner cup 16 and the second inner cup 18. An X-ray leakage into the anode button $\mathbf{10_1}$ through the glass bulb 14 and the peripheral wall $\mathbf{12_1}$ of the outer cup 12 is negligibly small so long as the glass bulb 14 is so improved as to reduce X-ray leak through it. It is therefore the bottom of the anode button $\mathbf{10_1}$ which determines how much an X-ray leak through the anode button $\mathbf{10_1}$ can be reduced. Thus, the X-ray leakage through the bottom $\mathbf{12_2}$ of the outer cup 12 and the first inner cup 16 is in effect the substantial X-ray leakage through the anode button $\mathbf{10_1}$.

Generally, an X-ray leakage through an anode button can be represented by the following formula:

$$I = I_0 \, \mathrm{EXP}\,(-\mu t) \qquad (1)$$

In formula (1), "I" denotes X-ray leakage, "$I_0$" an amount of X-ray generated, "$\mu$" the X-ray absorption coefficient of the material of the anode button, and "t" the thickness of the bottom of the anode button. The thicker its bottom is made, the more the anode button reduces the X-ray leak through it. Thickness t in formula (1) corresponds to the sum of the bottom thickness $t_1$ of the outer cup 12 and the bottom thickness $t_2$ of the first inner cup 16. Both bottom thicknesses $t_1$ and $t_2$ can be set in the order of a few milimeters. Made relatively thick, the bottom $16_2$ of the first inner cup 16 effectively prevents an X-ray leak.

As the material of the outer cup 12 a Ni-Cr-Fe alloy consisting of, for example, 40~49% of Ni 3~6% of Cr and Fe or Kovar may be used because it can be easily fastened with glass. On the other hand, the first inner cup 16 may be made of inexpensive iron because its primary object is to shield X-ray. The second inner cup 18, which is to be coupled to an external terminal (not shown) and to secure the first inner cup 16 steadfastly within the outer cup 12, is made of any conductive material, for example inexpensive iron. However, both inner cups 16 and 18 should be made of such material as would withstand the heat which will be generated when the anode button $10_1$, is sealed to the glass bulb 14. It is desired that the cups 12, 16 and 18 be made of materials having substantially the same thermal expansion coefficient. If the inner cups 16 and 18 are made of material having a larger thermal expansion coefficient than the material of the outer cup 12, the inner cups 16 and 18 are likely to rattle in the outer cup 12 after the anode button $10_1$ has been sealed to the glass bulb 14 and cooled to room temperature.

Figure 3:
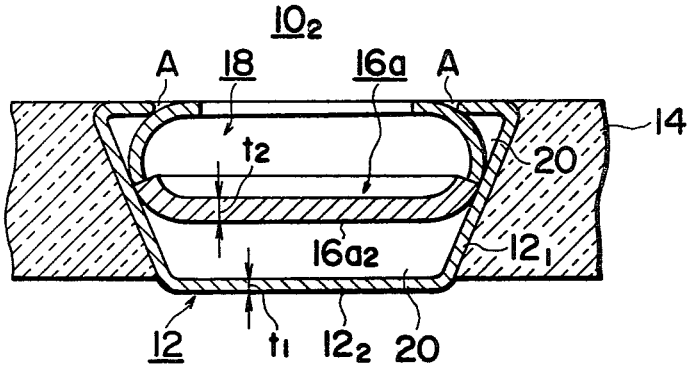
FIGS. 3 to 9 are cross sectional views of other embodiments of this invention.

An anode button $10_2$ shown in FIG. 3 is identical with the anode button $10_1$ illustrated in FIG. 2, except that its first inner cup **16*a* is made thicker. The first inner cup 16*a* being thicker, the anode button $10_2$ can reduce X-ray leak more effectively than the anode butbutton $10_1$ shown in FIG. 2. Also in the anode button $10_2$ two spaces 20 are provided, one space 20 between an outer cup 12 and the first inner cup 16*a* and the other space 20 between the outer cup 12 and a second inner cup 18. Owing to the spaces 20, the anode button $10_2$ can be sealed to a glass bulb 14 in a satisfactory manner for the aforementioned reason. In this embodiment the bottom $16a_2$ of the first inner cup 16*a* is spaced from the bottom $12_2$ of the outer cup 12. Instead, the bottom $16a_2$ may of course be put in contact with the bottom $12_2$ of the outer cup 12, just as in the anode button $10_1$ illustrated in FIG. 2**.

Figure 4:
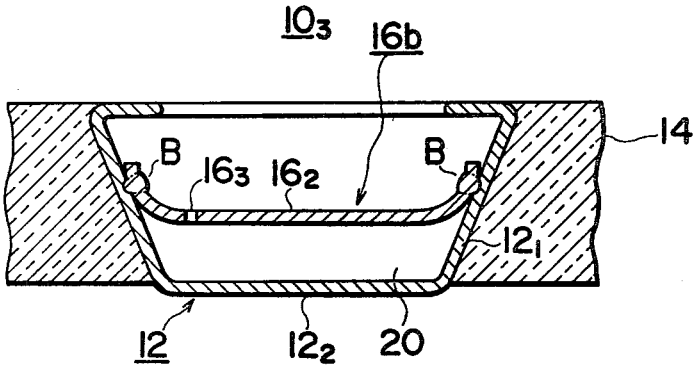

An anode button $10_3$ shown in FIG. 4 is characterized in that an inner cup **16*b* is welded to an outer cup 12. More precisely, the edge portion of the inner cup 16*b* is spotwelded to the peripheral wall $12_1$ of the outer cup 12 at portions B thereof. The inner cup 16*b* has so small a hole $16_3$ that an X-ray leak through it can be neglected. Through the hole $16_3$ the air in a space 20 between the outer cup 12 and the inner cup 16*b* can escape outside the anode button $10_3$. Thus, in the event of air expansion in the space 20 due to the heat used to seal the anode button $10_3$ to a glass bulb 14, the anode button $10_3$ is not be exerted with any unwanted stress. The hole $16_3$ is unnecessary if such an air expansion is not so large as to damage the anode button $10_3$ or if a gap is provided between the inner cup 16*b* and the peripheral wall $12_1$ of the outer cup 12**.

Figure 5:
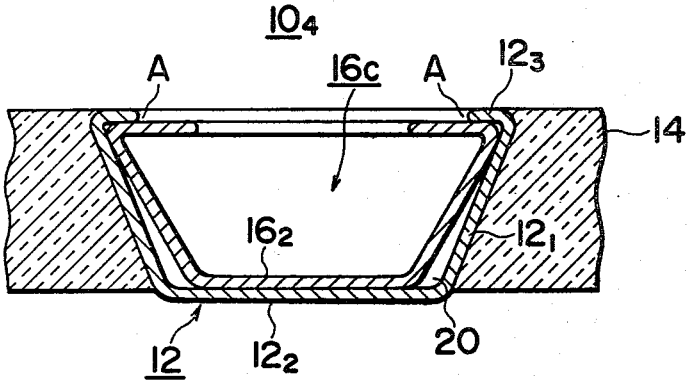

An anode button $10_4$ shown in FIG. 5 differs from the embodiment of FIG. 2 in that it is provided with a single inner cup **16*c*. The inner cup 16*c* corresponds to a combination of the inner cups 16 and 18 of the anode button shown in FIG. 2 and is therefore to be coupled with an external terminal (not shown). The inner cup 16*c* is steadfastly secured within an outer cup 12 since a flange $12_3$ of the outer cup 12 resiliently pushes an upper edge portion A of the inner cup 16*c***.

Figure 6:
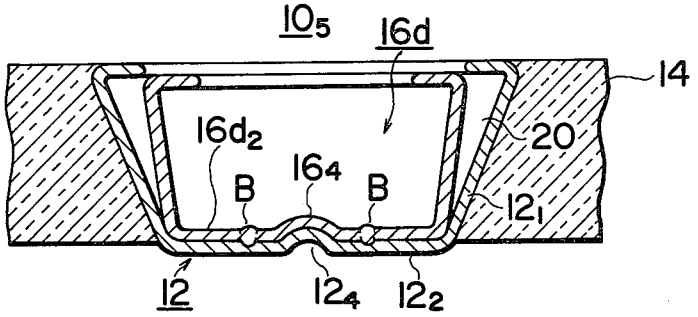

An anode button $10_5$ shown in FIG. 6 is identical with the embodiment of FIG. 5, except that its inner cup **16*d* is spot-welded at bottom portions B to a bottom $12_2$ of an outer cup 12. Further the anode button $10_5$ differs in that both cups 12 and 16*d* have protrusions $12_4$ and $16_4$, respectively, at the central of their bottoms. These protrusions $12_4$ and $16_4$ facilitate the positioning of the inner cup 16*d* inside the outer cup 12**.

Figure 7:
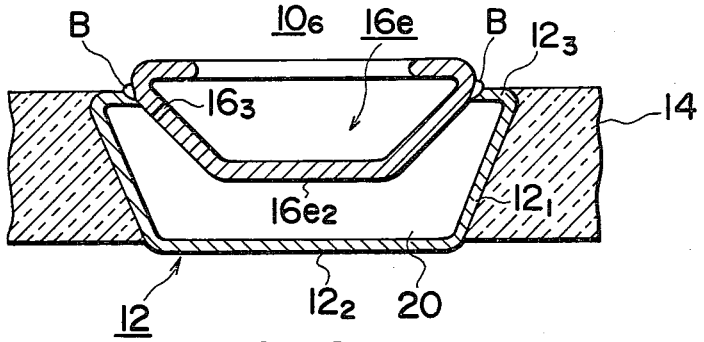

Another anode button $10_6$ shown in FIG. 7 is provided with a single inner cup **16*e* which corresponds to a combination of the inner cups 16 and 18 of the anode button illustrated in FIG. 2. The inner cup 16*e* is welded at a portion B to a flange $12_3$ of the outer cup 12. The inner cup 16*e* has its bottom $16e_2$ spaced from the bottom $12_2$ of the outer cup 12. Of course, the bottom $16e_2$ may be put in contact with the bottom $12_2$ of the outer cup 12 so long as a space 20 is provided between the outer cup 12 and the inner cup 16*e* so that the anode button $10_6$ can be well sealed to a glass bulb 14. The same can be said of any other embodiments shown in FIGS. 2 to 6**.

Figure 8:
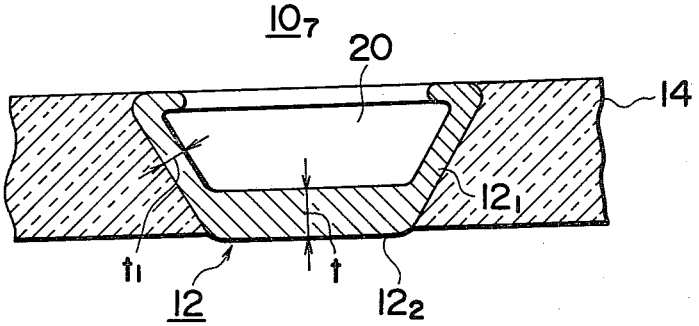

An anode button $10_7$ shown in FIG. 8 differs from all the above-described embodiments in that it is provided no inner cup. In this anode button the bottom $12_2$ of a single cup 12 is made so thick that it can alone shield X-ray to a satisfactory degree. In contrast, the peripheral wall $12_1$ of the outer cup 12 is made so thin that the anode button $10_7$ can be well sealed to a glass bulb 14. The thickness t of the bottom $12_2$ is larger than that of the peripheral wall $12_1$, preferably by 10% or more. The interior of the cup 12 can be considered to correspond to the space or spaces 20 in the anode buttons shown in FIGS. 2 to 7.

Figure 9:
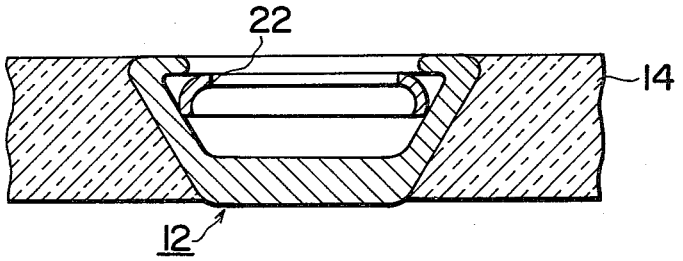

Still another anode button $10_8$ shown in FIG. 9 is identical with the embodiment of FIG. 8, except that a member 22 is provided in a cup 12. The member 22 is to be coupled to an external terminal (not shown).

The above-described anode buttons according to this invention can shield X-ray so effectively that the X-ray leak through them is several times as small as the X-ray leak through the conventional anode buttons of similar type to which no specific measures are taken against X-ray leak. In addition, the anode buttons according to this invention can be sealed to glass bulbs in a satisfactory manner. The measures against X-ray leak are taken before they are sealed to glass bulbs. They need not undergo any treatment against X-ray leak after they have been sealed to the glass bulbs, unlike the conventional anode buttons.

Moreover, the anode buttons according to this invention can be manufactured in almost the same processes as are made the conventional anode buttons of this type. Further they can be sealed to glass bulbs under almost the same conditions as the conventional ones. They can therefore be put to a practical use.

Although specific constructions have been illustrated and described herein, it is not intended that the invention be limited to the elements and constructions disclosed. One skilled in the art will recognize that the particular elements or sub-constructions may be used without departing from the scope and spirit of this invention.

What we claim is:

1. An anode button for a cathode ray tube, comprising:

an outer electrically conductive cup whose peripheral wall is made thin so as to be well sealed to a glass bulb constituting the cathode ray tube envelope and whose bottom is exposed to the interior of the cathode ray tube;

a first inner X-ray absorptive cup for substantially increasing the thickness of said bottom in its entirety in order to reduce X-ray leakage; and a second inner electrically conductive cup for holding the first inner cup, said peripheral wall and said first and second inner cups having enclosed spaces therebetween for preventing damage to the seal between said peripheral wall and said glass bulb.

2. An anode button according to claim 1, wherein the first and second inner cups are secured steadfastly in the outer cup by a resilient force exerted between the outer cup and the second inner cup.

3. An anode button for a cathode ray tube, comprising:

an outer electrically conductive cup whose peripheral wall is made thin so as to be well sealed to a glass bulb constituting the cathode ray tube envelope and whose bottom is exposed to the interior of the cathode ray tube; and an inner cup fixed and disposed in the outer cup for substantially increasing the thickness of said bottom in its entirety in order to reduce X-ray leakage, a portion of the inner cup which faces said bottom to be exposed to X-ray being thicker than the remaining portion, said peripheral wall and said inner cup having enclosed spaces therebetween for preventing damage to the seal between said peripheral wall and said glass bulb.

* * * * *